US007922778B2

(12) United States Patent
Grier

(10) Patent No.: US 7,922,778 B2
(45) Date of Patent: Apr. 12, 2011

(54) TIME AND TEMPERATURE ADDITIVE SCHEDULING

(75) Inventor: William Grier, Highland, CA (US)

(73) Assignee: Colorep, Inc., Rancho Cucamonga, CA (US)

( * ) Notice: Subject to any disclaimer, the term of this patent is extended or adjusted under 35 U.S.C. 154(b) by 111 days.

(21) Appl. No.: 11/690,003

(22) Filed: Mar. 22, 2007

(65) Prior Publication Data

US 2007/0240264 A1 Oct. 18, 2007

Related U.S. Application Data

(60) Provisional application No. 60/785,527, filed on Mar. 24, 2006.

(51) Int. Cl.
*D06P 5/28* (2006.01)

(52) U.S. Cl. ..... 8/471; 8/467

(58) Field of Classification Search ..... 8/467, 471
See application file for complete search history.

(56) References Cited

U.S. PATENT DOCUMENTS

| | | | | |
|---|---|---|---|---|
| 4,013,405 | A * | 3/1977 | Donenfeld | 8/471 |
| 4,265,631 | A * | 5/1981 | Becker | 8/471 |
| 6,251,210 | B1 | 6/2001 | Bullock et al. | |
| 7,037,346 | B2 | 5/2006 | Cates et al. | |
| 7,101,921 | B2 | 9/2006 | Edwards et al. | |

FOREIGN PATENT DOCUMENTS

| | | | |
|---|---|---|---|
| GB | 1211149 | * | 11/1970 |
| JP | 2001064885 | * | 3/2001 |
| KR | 2050328 A | | 6/2002 |

* cited by examiner

*Primary Examiner* — Lorna M Douyon
*Assistant Examiner* — Amina Khan
(74) *Attorney, Agent, or Firm* — Fish & Associates, PC

(57) ABSTRACT

A sublimation donor has a first fabric enhancer that sublimates from the donor above a first temperature. That is followed by a second fabric enhancer that sublimates from the donor above a second temperature. Both the first and second temperatures are above 260° F. and the second temperature is at least 10° F. higher than the first temperature. Upon sublimation under a single pass processing unit, first and second catalysts trigger the first and second fabric enhancers to sublimate at the first and second temperatures, respectively.

8 Claims, 2 Drawing Sheets

TIME AND TEMPERATURE ADDITIVE SCHEDULING

This application also claims priority to U.S. provisional application Ser. No. 60/785527 filed Mar. 24, 2006.

FIELD OF THE INVENTION

The field of the invention is in sublimation of textile products.

BACKGROUND

Conventional methods for textile manufacturing are complex due to the wide variety of steps, processes, substrates, and machineries involved. Starting from processing raw natural or manufactured fibers into finished fabric, textile operations can be broadly classified into two steps: dry processing and wet processing. Dry processing involves many steps, but they are mainly mechanical processes and they tend not to produce as much environmental waste as wet processing. Wet processing involves not only mechanical processes, but also chemical heavy preparation that can create significant environmental impact.

During traditional wet processing, fabric has to be cleaned and prepared, and that often involves scouring, bleaching, heat setting, texturing and so forth. Once prepared, the fabric is ready for printing and dyeing and is often followed by a finishing step in which the fabric is conditioned with different chemicals, such as fabric softeners, anti-microbial agents, stain-release agents and so forth, for more effective characteristics and performance.

There are at least two major problems associated with the traditional wet processing method. First, many individual steps are required under separate operations, which means multiple machines must be used. The different machines and steps often require the textile to travel from site to site or even from country to country for assembly into the final product.

Attempts have been made to save time and labor costs by consolidating a few chemical processes into one step. U.S. Pat. No. 6,251,210 (to Bullock) describes a method to finish a fabric with both stain resistant, water repellant and anti-microbial agents in one setting. U.S. Pat. No. 7,037,346 (to Cates et al.) also describes a textile substrate that contains multi-finishes in the fluorochemical group. Once both cationic and repellant properties are applied to the fabric, the fabric is then dipped into an aqueous solution before being moved to a printing station for printing and dyeing. The drawbacks of these patents are that they still do not solve the problem of consolidating multiple processing steps into one single, continuous process. Again, the multiple processing steps generate significant cost in time and labor but they also create a second more serious problem—pollution.

The use of catalysts and chemicals during traditional wet processing often generates a panoply of environmental waste ranging from air to water pollutants. Efforts have been made in which a single-pass sublimation machine is used that consolidates many of the processing steps into one continuous process. However, by failing to identify commercially viable non-polluting catalysts, the single-pass process still faces a hurdle for successful commercial application.

Various efforts also have been made to generate non-polluting catalysts such as shown in U.S. Pat. No. 7,101,921 (to Edwards) and Korean Pat. No: KR2050328A (to Cha et al.), but these catalysts are still unable to provide for textile preparation in one combined single-pass machinery. The challenge is to combine a single-pass machine that incorporates all the wet processing steps into one continuous process with non-polluting catalysts that limit labor costs, time, and pollution.

Thus, it would be desirable to have a textile that is both pre-treated, and be activated and conditioned in a continuous process with more efficiency and that generates less pollution. It would also be desirable to have a fabric that can enter into a machine as roll goods or cut piece to be prepared, finished and permanently dyed, and printed in less than one continuous minute, and be ready for immediate cutting or sewing.

SUMMARY OF THE INVENTION

The present invention provides apparatus, systems, and methods in which a sublimation donor comprises different fabric enhancers that are activated at different temperatures.

In a preferred embodiment, a sublimation donor has a first fabric enhancer that sublimates from the donor above a first temperature and is followed by a second fabric enhancer that sublimates from the donor above a second temperature. Both the first and second temperatures are above 260° F. and the second temperature is at least 10° F. higher than the first temperature.

In another preferred embodiment, there is a first and second catalyst that triggers the first and second fabric enhancers to sublimate at the first and second temperatures, respectively. The catalysts are selected from the group consisting of olefins, sulfonium compounds, polyaniline compounds, and tetra-amido macrocyclic ligands. Fabric enhancers may include finishing and conditioning agents.

In yet another preferred embodiment, one of the fabric enhancers is a bleach, anti-microbial substance, or stain release agent. The first and second temperatures differ by at least 20° F. and 30° F. It is also contemplated that the donor has a first and second different colorant, each of which sublimates from the donor at a temperature greater than 360° F.

In an alternative preferred embodiment, a fabric produced using the sublimation donor sublimates a first and a second fabric enhancer at a first and second temperature. Furthermore, the fabric also contains visibly detectable amounts of both a first and second colorant, the fabric contains a detectable amount of the first fabric enhancer, and the first fabric enhancer is selected from a bleach, an antimicrobial substance, and a stain release agent.

In a preferred embodiment, the first and second colorants are sublimated onto the fabric in a continuous disposition. The fabric contains a detectable amount of the second fabric enhancer, and each of the first and second fabric enhancers are selected from bleach, an antimicrobial substance, and a stain release agent.

In yet another preferred embodiment, a receiver comprises a first fabric enhancer that activates to the receiver above a first temperature, and a second fabric enhancer that activates to the receiver above a second temperature. The first and second temperatures are each above 260° F., and the second temperature is at least 10° F. higher than the first temperature.

In another preferred embodiment, a method of operating a sublimation printing device is comprised of: providing a donor that accepts a first and second enhancer; juxtaposing at least a portion of the donor with at least a portion of a receiver; and then heating the donor from temperature (T1) to temperature (T2) for a period of time (S), defined by $Q=M\cdot(T1-T2)\cdot S$. Q is energy in calories needed to sublimate the donor and M is the mass in grams per $cm^2$ of the receiver. The relationship is such that the longer sublimation time and temperature is needed depending on the mass of the receiver and the heat source capabilities.

In yet another preferred embodiment, a method of operating a sublimation printing device is provided by first providing a donor that has a first fabric enhancer that sublimates from the donor above a first temperature and is followed by a second fabric enhancer that sublimates from the donor above a second temperature, juxtaposing at least a portion of the donor with at least a portion of a receiver; and then heating the donor from 260° F. to 385° F. over a time period of at least 0.35 seconds, 0.5 seconds or 0.7 seconds.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
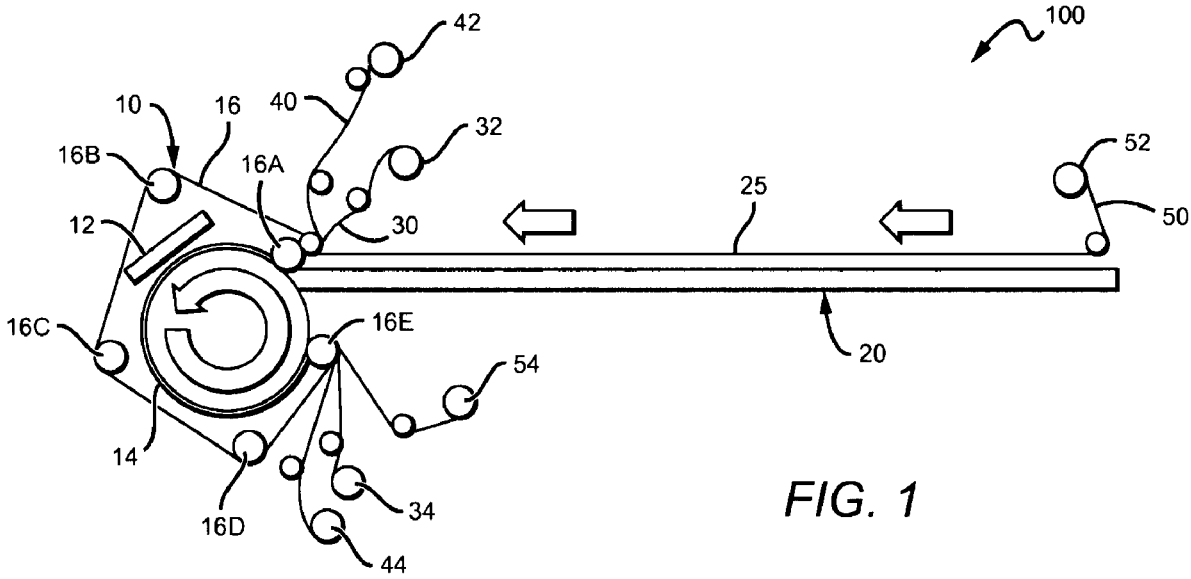
FIG. 1 is a schematic of processing equipment according to the teaches herein.

The inventor discovered that donor carrier treated with a variety of native elements, such as non-polluting catalysts, can be activated one element at a time via sublimation following a discreet temperature with a predetermined timed schedule. Preferably, a treated donor, unlike the standard donor that comes with only process dyes, is primed with a variety of different chemical elements, such as bleaching agents, fabric enhancers and a variety of other fabric altering agents.

The present inventive subject matter uses a single source of energy to trigger a succession of chemical events stacked on the treated donor carrier. The sublimation process is controlled via a predetermined time and discreet temperature schedule. The combination of the treated donor and the control of time and temperature allow the single-pass process sublimation to be carried out in the most efficient, cost-effective way, and that also substantially reduces pollution.

I. Treated Donor

In general, a donor has to be treated with either special dyes or other types of chemical agents to sublimate onto a receiver. The chemical agents used and defined herein in the broadest possible sense include chemicals, agents, and materials that can prepare or condition the surface of the fabric when applied upon exposure to moisture and certain temperatures.

Especially, a donor can be treated with a "preparation agent" or "preparation agents." Preparation agent or agents clean or prepare the fabric prior to finishing, printing and dyeing. Normally, preparation agents are applied first during the sublimation process. Preparation agents can be selected from known materials used in the industry to prepare the fabric; for example, the preferred preparation includes bleaching. However, preparation agents also include agents or chemical compositions that cause heat-setting, desizing, singeing, scouring, and even mercerization for cotton.

In a preferred embodiment, a donor proceeds to a finishing step. The finishing step of the fabric includes any operation that improves the appearance and/or usefulness of fabric. While finishing encompasses several mechanical processes, such as texturing or napping, it is contemplated that the present finishing prefers to be a chemical process, which utilizes fabric enhancers. The terms "fabric enhancer" and "fabric enhancers" used herein are defined in the broadest possible sense to include chemicals, agents, and materials that can treat, finish or condition the surface of the fabric when applied upon exposure to moisture and certain temperatures. Fabric enhancers can be selected from known materials used in the industry to enhance the performance, such as fabric softener, permanent press agents, anti-microbial agents, stain-repellent agents, adhesive agents, water-resistant agents, fire-resistant agents, antistatic agents, stiffeners, anti-creasing agents, deodorants, moth resisting agents, oil repellants, rust preventatives, and shrinkage controllers. It is also contemplated that fabric enhancers include conditioning agents, pharmaceuticals, and nutraceuticals agents that provide nutritional values through the catalytic conversion of the fabric surface into the wearer's skin. Skin-absorbent agents can also be used in which specific chemicals can be padded on a fabric and delivered to the skin with each wash.

It is preferred that the chemical finishing using fabric enhancers be done on a single, continuous finishing process unit or range along with the step of preparing the fabric. Depending on the desired characteristics of the end products, some fabric may be finished more than others. It is important to note that there is no set recipe for the chemical process used for any fabric substrate. Different fabric enhancers are contemplated to be activated upon a given temperature for a given time period.

Other chemical agents and additives include, but are not limited to, builders, surfactants, enzymes, bleach activators, bleach boosters, bleaches, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents, water resistant agents, fire retardant agents, and mixtures thereof.

The catalysts used to activate the chemical elements are preferably environmental friendly catalysts which have little, if any, toxic substances. Some preferred catalysts include olefins, sulfonium compounds, polyaniline compounds, and tetra-amido macrocyclic ligands. However, it is contemplated that any environmental friendly or "green" catalysts can be used to activate the chemical native elements on the fabric.

In a preferred embodiment, printing and dyeing fabric is the final step in a continuous sublimation process. Upon heating, dyes and colorants will react to and form an affinity with certain fiber surfaces. With dye-based formulation, the heating step of the process causes the dye particles to change from a solid state to a gas state. In a gas state, the dye particles enter into a tissue, such as polyester fabric fibers, to set the dye. The heat opens pores in the polyester fiber allowing the gas to enter in a molecular form which is more highly reflective and capable of producing more brilliant color on the substrate. Following a cooling stage, the dye particles are trapped internally in the polyester fiber, possibly reverting back to their solid state or at least being fixed in the solid substrate fibers. So when white fabric is placed against printed donor material and heat is applied to the material, the molecules are excited and transformed into a gas state. As heated dye molecules now penetrate the heated fabric, the dye particles permeate the fabric and become part of the fabric filament. Now the dye laden molecules are a permanent part of the interior of the fabric and are not affected by normal washing or bleaching.

It should also be appreciated that the terms "dye," "dyes," "colorant," and "colorants" are used in the broadest possible sense to include inks, and indeed any chemical composition that can be transferred to a receiving material to color that material. Thus, the terms "dye," "dyes", "colorant" and "colorants" include chemical compositions that can change color depending upon temperature or other conditions, and even chemical compositions that are colorless when applied, but turn color upon exposure to moisture, or high temperature.

It is further contemplated that a receiver can be used directly to react with different chemical agents. A device can place, spray or inject different chemical agents directly onto the receiver. As the receiver goes through a time and temperature schedule, the chemical agents are released and the catalytic phase occurs directly on the receiver. This can even apply to special dyes which are injected into the receiver and react to a direct or indirect heat source for a set amount of time. Under a heat source, the dyes react and activate onto the receiver and stay the same. This preferably is more applicable in the area of carpets and rugs where sublimating donor material does not always yield the best results. By directly activating the receiver, chemical agents and dyes can be set more effectively.

II. Implementation

In an exemplary configuration as depicted in FIG. 1, process unit 100 generally includes heating portion 10 and work table 20. Positioned on the machine is a continuous work piece 25 comprising: donor material 30 with corresponding donor feed roll 32 and donor take up roll 34; tissue 40 with corresponding tissue feed roll 42 and tissue take up roll 44; and receiver 50 with corresponding receiver feed roll 52 and receiver take up roll 54.

In a preferred embodiment, process unit 100 can handle preparing, printing and dyeing and finishing the textile in one single press. The advantage of such a process is that the finishing steps can be achieved before the dyeing and printing steps.

Preferably, donor material 30 can be selected from known donor papers, or other materials used in the industry. It is contemplated that donor material 30 is conditioned by a plurality of preparation agents, fabric enhancer, and dyes. The donor material preferably is a thin sheet that has a surface in which the preparation agents, the fabric enhancers and dyes can be temporarily held. Upon heating the donor material for a certain amount of time frame and at a certain temperature, a catalytic mechanism is triggered into releasing the preparation agents, the fabric enhancers and dyes onto the fabric.

Additionally, a use of a nonpolluting catalyst, such as TAML®, for Iron-Tetra Amido Macrocyclic Ligand, a compound discovered at the Carnegie Mellon's Institute for Green Oxidation, can be added to trigger the release mechanism for dispersion of the preparation agents, the fabric enhancers and the dyes to work faster and more safely. Other nonpolluting catalysts such as the macrocyclic tetra amides described in column 4, lines 6-24, U.S. Pat. No. 6,100,394 (to Collins et al.), are also contemplated. This reference is incorporated herein by reference in its entirety. Where a definition or use of a term in an incorporated reference is inconsistent or contrary to the definition of that term provided herein, the definition of that term provided herein applies, and the definition of that term in the reference does not apply.

Donor material 30 then goes through a heating portion 16 for sublimation. The heating portion 16 generally includes a rotary primary heating element 12, a fixed heating element 14, and a heat conductive web 16. The web 16 is positioned by positioner's 16A-16E. The rotation speed, configuration and dimensions of the heating portion 16 determine the dwell time of sublimating heat upon the sandwiched work piece of donor materials 30, receiver 50 and tissue 40.

Thus, it is contemplated that the range of heat sufficient to sublimate the whole process from preparing the fabric to finishing the fabric and finally to printing and dyeing the fabric would be applied from at least one side of the receiver for at least for at least 5 seconds, more preferably at least 10 seconds, 20 seconds, 40 seconds, 60 seconds, and most preferably at 80 seconds. However, it is contemplated that any heating from 5 seconds to 30 minutes is the anticipated acceptable range.

It is also contemplated that the range of sublimation temperature for the whole process starts from preferably no less than 260° F., and preferably no more than 390° F.

However, the temperature and time window to sublimate depends on the characteristics of the receiver. The relationship between time and temperature schedule as to the calories needed for a particular size receiver is as follows:

$$Q=M\cdot(T1-T2)\cdot S.$$

M defines mass which is measured in grams per $cm^2$ of the receiver. T1 defines a first temperature and T2 defines a second temperature. S defines time in seconds. The relationship is such calories needed depend on the mass of the receiver and the range of time and temperature. Preferably temperature range is at least 260° F. and no more than 440° F. However, it is contemplated that depending on the mass of the receiver, different temperature ranges are needed.

Heating by forced hot air is preferred, although other heat sources, such as infrared heaters, can be used as long as they adequately penetrate the fabric to the depth of the ink. In addition to heat, other mechanisms can be used for activating the chemical elements or catalysts within the donor and setting the dye, which can be determined from those mechanisms commonly used with particular catalysts, dyes and substrate combinations.

Preferably, a heat source is applied continuously onto the donor to sublimate. However, it is contemplated that heat can be indirectly applied to the receiver without damaging the receiver. A heat source can even be applied in short pulse intervals to obtain maximum temperature without prolonged exposure. High energy provided in the form of high temperature for a very short amount of time, breaks the bonds and disperses the heat on a donor. For example, as a donor sublimates onto a receiver, heat is pulsed only on the side of the donor that is not touching the receiver. Catalytic conversions of the chemical agents still occur during the pulsing of the heat source even with a higher rising temperature. If the heat is not pulsed at a higher temperature, the receiver can be damaged. Pulsing the heat source permits different catalytic phases to occur on the receiver regardless of the donor's phases. It is another example of the flexibility of the time and temperature schedule.

Despite a current preference for continuous processing, it is also contemplated that embodiments of the inventive subject matter could be practiced in a discontinuous manner; for example, with sandwiched work pieces being assembled, and heat and pressure applied in a piece-by-piece manner. In that regard, it is specifically contemplated that the receiver could be cut from a bulk material. There are existing machines (e.g. Monti Antonio™, Practix™ and other cylinder based machines) that could be modified to operate according to the inventive concepts described herein.

In a preferred embodiment, upon a schedule, the donor materials will either react or form an affinity with different preparation agents, fabric enhancers, and dyes. It should also be appreciated that the terms "schedule", "schedules" are used in the broadest possible sense to include the specific and discreet time and temperature upon which either a preparation agent, a fabric enhancer, or dye is activated and dispersed into the fabric. Thus, the terms "schedule" and "schedules" include a range of temperature for a set time frame.

For example, as donor material enters into the process equipment, first preparation agent, preferably a bleach, will be activated when upon a first schedule, when the temperature reaches 290° F. but not more than 320° F. for at least 1.8 seconds.

In an alternative embodiment, first preparation bleach is activated upon the addition a first catalyst and a first schedule. Due to the nature of first catalyst, first schedule preferably includes a higher temperature at a shorter time frame.

Following the activation of the first preparation agent, donor material conceivably goes through process equipment for the activation of a second preparation agent at a second schedule. Alternatively, a first fabric enhancer is activated at the second schedule. For example, a fabric softener, calcium hypochlorite, can be activated upon the second schedule. The second schedule preferably has a temperature of 320° F., which is higher than first schedule and at a time frame of about the same as first schedule. A third fabric enhancer is then activated at a third schedule, which preferably has a temperature of 345° F. higher than second schedule and a time frame of about the same as second schedule. The process repeats itself until all the fabric enhancers have been activated and dispersed into the fabric.

Preferably, following the activation of all fabric enhancers, a first dye will be applied to donor material at a fourth, fifth, sixth, etc. schedule for dispersion. It is contemplated that the heating step of the process causes the dye particles to change from a solid state to a gas state. The preferred temperature range for dye particles to enter the receiver is preferably more than 360° F. for at least 2.5 seconds. However, other ranges, such as a temperature of 380° F. to 420° F. for at least 10 seconds are also contemplated. As heated dye molecules enter the now heated fabric, they exchange places and become part of the fabric filament. Now the dye laden molecules are a permanent part of the interior of the fabric and are not affected by normal washing or bleaching.

Receiver 50 can be any material that can receive sublimation printing. This includes most especially polyesters and other synthetic polymers that absorb dyes at high temperature and pressure, with currently preferred receiver materials including the true synthetics or non-cellulosics (e.g., polyester, nylon, acrylic, modacrylic, and polyolefin), blends, and so forth. It is contemplated that receiver materials could also include natural fibers (e.g., cotton, wool, silk, linen, hemp, ramie, and jute), semi-synthetics or cellulosics (e.g., vicose rayon and cellulose acetate), but currently available colorants do not "take" very well with such fibers. Receivers can be flexible or rigid, bleached or unbleached, white or colored, woven, non-woven, knitted or non-knitted, or any combination of these or other factors. Thus, a receiver could, for example, include a woven material on one side and a non-woven or different woven material on the other side. Among other things, receivers are contemplated to include fabrics and fibers used for clothing, banners, flags, curtains and other wall coverings, and even carpets.

Tissue 40 can be selected from known take up tissues used in the industry and is used in the current embodiments to absorb dyes that pass entirely through receiver 50 and donor material 30. It also serves in embodiments of the present invention to protect the mechanical parts from excess colorant.

The advantages of the methods and systems disclosed herein are enormous. Instead of shipping fabric from site to site and often from country to country in preparation for assembly into a final ready-to-wear product, a single process provides for the preparation, finishing, printing, and dyeing of fabric. This one-stop shop process not only saves a tremendous amount in costs and time, but also effectively eliminates many chemical wastes that accompany traditional textile production methods.

By having a discreet time and temperature scheduling for chemical additives, the present inventive subject matter overcomes the hurdles that blocked a single-pass process method from previous efforts. Besides providing a nonpolluting catalysts for activation of a chemical additive, a single source energy combined with a discreet application and scheduled delivery provide for a even more comprehensive and efficient process to prepare textile. The reduction in time and labor costs provides an attractive and commercially viable application for the present inventive subject matter.

EXAMPLES

The following examples illustrate particularly embodiments of the present inventive subject matter, and aid those of skill in the art in understanding and practicing the inventive subject matter. They are set forth for explanatory purposes only, and are not to be taken as limiting the present inventive subject matter in any manner.

Example 1

Chemical Agents

The following are a group of chemical agents that can be used during sublimation following a predetermined time and discreet temperature schedule.

Bleach

Typically, for performance based fabric, bleaching is a preferred method of preparing the fabric. The purpose of bleaching is decolorizing naturally present pigments into whitened fabric that can accept dyes without damaging the fabric. Many sources of bleach may be used, such as oxidative bleaches and reductive bleaches. Preferably, oxidative bleaches, such as sodium hypochlorite (NaOCl), calcium hypochlorite ($CaCl_2O_2$), hydrogen peroxide, persulfates, perboarates and percarbonates along with peracetic acid; and reductive bleaches, such as sulfur dioxide and sodium dithionate can be used as bleaching agents.

More preferably, calcium hypochlorite or sodium hypochlorite, are used. Both of which are excellent cidal agents for mildew and other bacteria found and both can be found commercially. Commercial sodium hypochlorite contains at least 12 to 15% active chlorine and sodium hypochlorite can be found as a solid material that contains at least 65% active chlorine.

Time and temperature of bleaching are interrelated. As the temperature increases, less time is needed to activate the bleaching agent. Higher bleach concentration also requires less time and temperature for activation. Preferred sources of bleach are used as long as they can be activated in room temperature or a temperature from 280° F. to 320° F. in a preferred time period of 1.8 seconds to 2.2 seconds.

The amount of bleaching agents used depends on the different types and characteristics of the fabric. For example, when darker dyes are to be used, fabrics may not necessarily need to be bleached. Example of a preferred bleaching formulation can be shown in Table 1.

TABLE 1

| Bleach Formulation | |
|---|---|
| NaOCl | 2.5% active bleach |
| Na2CO3 | 1.0% pH buffer |

Preferably bleaching is performed under single continuous equipment in which the time and temperature are correlated to activate the bleaching agents onto the fabrics.

Other types of bleaches, such as hydrogen peroxide, may require higher temperature to decompose and depending on the other agents used, may serve as a better bleaching agent in single continuous sublimation equipment. Sodium chlorite, another bleaching agent that allows for bleaching at a much higher rate of temperature is also contemplated.

Fabric Softener

Fabric softeners are used to improve the way fabric feels by breaking down hardness or stiffness. Softeners also improve abrasion resistance, increase tearing strength, reduce sewing thread breakage and reduce needle cutting when the garment is sewn. Most softeners are divided into three major chemical categories describing the ionic nature of the molecule: anionic, cationic and nonionic. Most softeners are also based on fatty acid amine condensates and can be used in a wide range of time and temperature delivery process.

Preferred softeners are anionic softeners, which exhibit excellent stability under high temperature. Anionic softeners, such as sulfates, sulfonated fatty amides, and esters do not interfere with finishes and act like defoamers, and exhibit substantial rewetting properties. Fabrics that are treated with softeners are contemplated to be carried in a discreet time and temperature schedule. A preferred softener is made from the synthesis of the fatty acid amide basis and the addition of suitable additives into the softener formulation, along with the addition of a lubricant that can be activated by acidic catalysts.

Compositions of the softeners can vary depending on the desired effects and the nature of the fabric being treated. Hydrocarbon radials having a total of 8 to 20 carbons are the most effective molecular group used in textile softeners. Preferably, high-class, multifunctional softeners are contemplated, which not only contain emulsified fatty acid condensates but also different silicones and waxes respectively. Such combinations not only allow for distinctly better effects but the properties of the softeners can be tailor-made to meet the individual requirement profile.

Many sources of fabric softener may be used as long as they can be activated in room temperature or a temperature from 310° F. to 350° F. in a preferred time period of 2.0 seconds to 2.3 seconds. For example, U.S. Pat. No. 4,185,961 (to Danzik) describes a fabric softener comprises an aqueous solution containing dimethyloldihydroxy ethylene urea (DMDHEU) and an acidic catalyst in column 2, lines 14-21. U.S. Pat. No. 7,108,725 (to Caswell) describes a fabric softener comprising a film encapsulating a water-soluble composition with the composition comprises from about 5% to about 20%, by weight of the composition, of a polydimethyl siloxane or derivative thereof in column 61, lines 52 to 67 and column 62, lines 1 to 45.

Nonionic softeners, such as silicones, ethylene oxide derivatives, and hydrocarbon waxes based on paraffin or polyethylene are also contemplated. Silicones, for example, are water clear oils that are stable to high temperature and do not discolor fabric.

Repellent Agents

Many sources of repellent agents can be used. Stain repellents treat fabric to withstand penetration of liquid or soil under static conditions involving only the weight of the drop and capillary forces. Oil repellent agents resist oil from residing on the top of the fabric and stop the oil from penetrating to the fabric surface. Water repellent agents activate pores on fabric surfaces to permeate air and water vapor, unlike water proofing agents, which blocks the penetration of water under higher hydrostatic pressure.

For fabrics to be water repellent, the critical surface tension of the fiber's surface must be lowered to about 25 to 30 dynes/cm. Oil repellency requires that the fiber surface be lowered to 13 dynes/cm. Preferred sources of repellent agents include fluorocarbon finishes. Fluorochemical polymers prevent oils from penetrating into the fabric or prevent soils from sticking to the fiber surface. Most fabric stains are caused by liquids depositing coloring matter on the fabric. For textiles that cannot be laundered, e.g. upholstery fabrics and carpets, fluorochemical finishes provides a more efficient and effective delivery for stain and soil repellency. A typical formulation is shown in Table 2. The finish can be applied by padding the formulation onto the fabric through a single process sublimation unit at a temperature of at least 330° F. to 370° F. for least 2.2 seconds to 2.4 seconds. Drying cycles is accomplished by super heating the fabric for the next step in the additive delivery schedule.

TABLE 2

| Fluorochemical Repellent Formulation | |
|---|---|
| Agents | % Bath Concentration |
| Fluorochemical product | 2.0-3.0 |
| Resin wax water repellent | 2.0-3.0 |
| DMDHEU | 10-15 |
| MgCl2 catalyst | 2.5-4.0 |
| Polyethylene softener | 0.5-2.0 |
| Non-wetting surfactant | 0.03-0.05 |
| Acetic acid | 0.05-0.1 |

Other types of repellent agents such as, paraffin waxes, hydrocarbon based hydrophobes, N-methylol stearamide, pyridinium compounds, resin formers, and even silicones are contemplated. Repellent agents are applied as an organic solvent.

Stain Release Agents

Stain release agents condition the fabrics to block out the tougher particles and soils that can penetrate the fabric. Most stain release agents are nonionic; for example, the nonionic stain release polymer described in U.S. Pat. No. 4,849,257 (to Borcher, Sr., et al.), abstract, which is incorporated herein by reference. A preferred stain release agent is a polymeric agent that includes copolymeric units of repeating units of ethylene and/or propylene groups. Fluorochemical polymers are an example of nonionic soil release agent that provide excellent dual action for oil and stain release. For example, Scotchgard Brand Dual-Action Fabric Protector, a unique block co-polymer, developed by 3M Company provides dual action clean. The hybrid polymer backbone is comprised of segments based on polyoxyethylene united with segments containing long-chain perfluoroaliphatic groups.

Other useful stain release agents can include anionic and cationic polymers. Suitable anionic polymeric or oligomeric soil release agents are disclosed in U.S. Pat. No. 4,018,569 (to Chang), column 3, lines 25-50, which is incorporated herein by reference. Other suitable polymers are disclosed in U.S. Pat. No. 4,808,086 (to Evans et al.), column 2, lines 45-55, which is incorporated herein by reference.

The finish preferably can be applied by padding the formulation onto the fabric through a single process sublimation unit at a temperature of at least 330° F. to 370° F. for least 2.2 seconds to 2.4 seconds.

Antimicrobial Agents

Antimicrobial agents alter the characteristics of fabric surface to prevent penetration of microbial or bacterial agents from entering the fabric. Preferred sources of antimicrobial agents include high performance agents that contain silver ions—such as silver oxide—an excellent antimicrobial agent. Exhibiting a polar charge, the silver generates an ion field on the surface of the fabric and the bacteria exchange ions with the silver oxide upon contact with the fabric, in turn ripping open their cell walls and killing them. U.S. Pat. No. 6,436,420 (to Antelman et al.) describes a high performance silver antimicrobial agent that is a suitable source.

Other non-silver sources are also contemplated. U.S. Pat. No. 5,271,952 (to Liang et al.), abstract, U.S. Pat. Nos. 4,410,593 to (to Tombie et al.), abstract and U.S. Pat. No. 5,458,906 (to Liang), abstract, all disclose copper ions as a suitable source of anti-microbial agents. Recent technology allows nanopolymers to be encapsulated onto the surface of fabric for greater penetration and dispersion, such as the one described in the detailed description of U.S. Pat. No. 7,112,621 (to Rohrbaugh). Finally, U.S. Pat. No. 6,251,210 (to Bullock et al.), column 4, lines 33-50, describes a method of preparing a stain resistant, water repellent and anti-microbial agents on a textile fabric. All these references herein are incorporated in their entirety.

Similarly, anti-microbial agents preferably can be applied by padding the formulation onto the fabric through a single process sublimation unit at a temperature of at least 330° F. to 370° F. for least 2.2 seconds to 2.4 seconds.

Adhesive Agents

Adhesive agents are preferably applied for flocking. Flocking is a method of cloth ornamentation in which finely chopped fibers are applied to adhesive coated surfaces. The majority of flocking uses finely cut natural or synthetic fibers. In the flocking process, the fabric substrate is first coated with an adhesive, followed by applying fine or monofilament fibers (usually nylon, rayon or polyester) and dried. The flocked finish imparts a decorative and/or functional characteristic to the surface, such as school initials or emblems.

The diameter of the individual strand is preferably a few thousandths of a centimeter and ranges in length from 0.25 mm to 5 mm. In a preferred embodiment, a layer of adhesive is first applied onto the donor substrate, followed by a quick dry at a high temperature. This removes moisture from the adhesive, but still leaves the crystalline properties of the adhesive. Then, the flock fibers are applied and upon release, the adhesion creates a low tensile strength that would allow the fibers to be vertical and stand up to create the flocking effect.

Flock can be natural or synthetic materials, such as cotton, rayon, nylon and polyester. A preferred type of flock is cut flock, which is produced from quality filament synthetic materials. The cutting process produces a very uniform length of flock. Preferred lengths of the flock range from 0.3 mm to 0.5 mm and 1.7-22 dtex in diameter. However, milled flock, which is produced from cotton or synthetic textile waste material, is also contemplated.

A variety of adhesives can be used for flocking purposes. In general, flock adhesives are in both a single and two-part catalyzed system. A preferred adhesive can be either plastisol or water-based adhesives and have the consistency of plastisol ink.

Dyes and Colorants

Preferred dyes and colorants for use in the present compositions include highly water-soluble dyes, for example, LIQUITINT dyes available from Milliken Chemical Company. Any dye can be used in the compositions of the present invention, but nonionic dyes are preferred to decrease interaction with the zeta potential modifier and/or with the dye transfer inhibitor employed in combination with the inventive compositions.

Suitable colors include, but are not limited to, Acid Black 1, Acid Blue 3, Acid Blue 9 Aluminum Lake, Acid Blue 74, Acid Green 1, Acid Orange 6, Acid Red 14 Aluminum Lake, Acid Red 27, Acid Red 27 Aluminum Lake, Acid Red 51, Acid Violet 9, Acid Yellow 3, Acid Yellow 3 Aluminum Lake, Acid Yellow 73, Aluminum Powder, Basic Blue 6, Basic Yellow 11, Carotene, Brilliant Black 1, Bromocresol Green, Chromium Oxide Greens, Curry Red, D&C Blue No. 1 Aluminum Lake, D&C Blue No. 4, D&C Brown No. 1, D&C Green No. 3 Aluminum Lake, D&C Green No. 5, D&C Orange No. 4 Aluminum Lake, D&C Red No. 6, D&C Red No. 6 Aluminum Lake, D&C Violet No. 2, D&C Yellow No. 7, D&C Yellow No. 11, D&C Blue No. 1, FD&C Yellow No. 5 Aluminum Lake, iron oxides, Pigment Orange 5, Pigment Red 83, Pigment Yellow 73, Solvent Orange 1, Solvent Yellow 18, ultramarines, and zinc stearate.

Example 2

Single Pass Additive Scheduling Chart

One embodiment of the present inventive subject matter is the sublimation of a donor material that includes the activation of a bleaching agent, an anti-microbial agent, and/or a stain-release agent, followed by the printing and dyeing of the donor.

Figure 2:
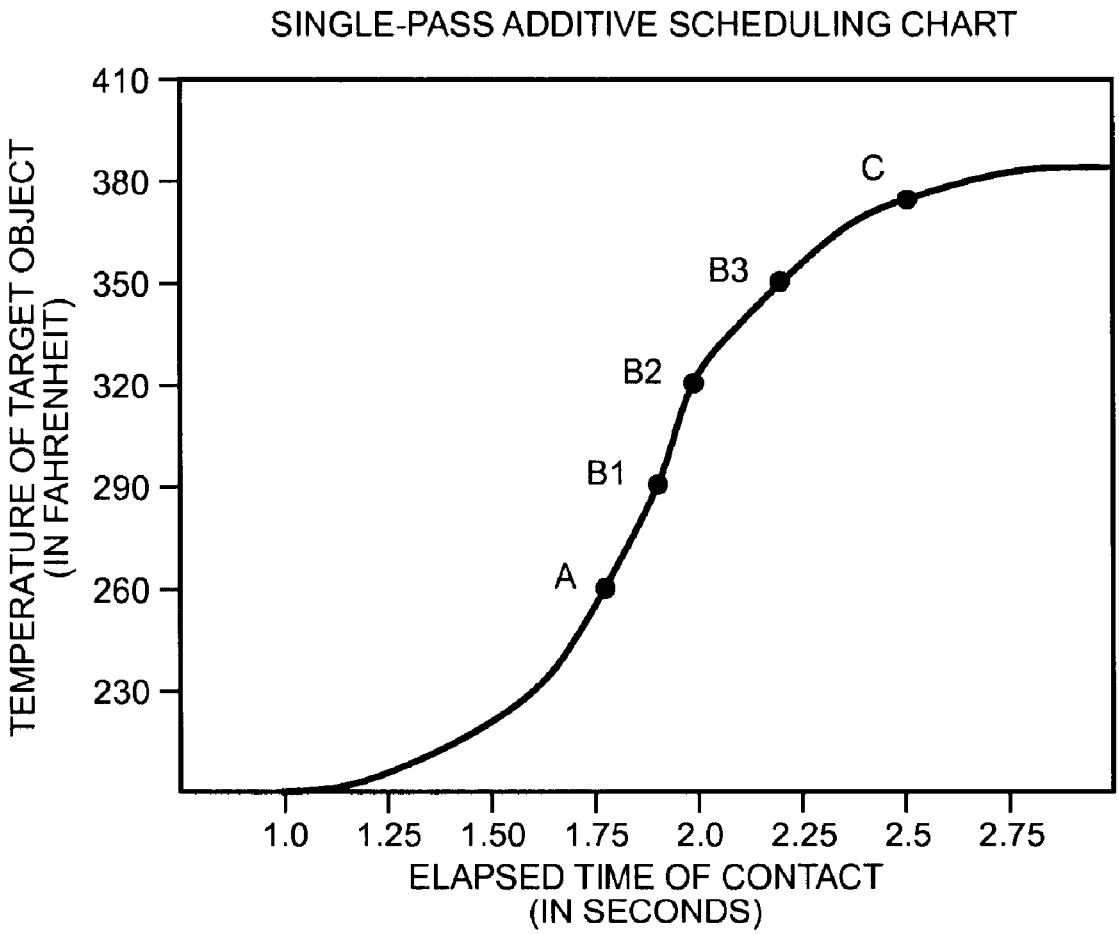
FIG. 2 is a chart displaying the relationship between the time and the temperature for releasing the chemical elements.

The scheduled release and bonding of each of the stacked chemical agents are completed based on a temperature defined time window. The chemical agents are applied as either a layer or component of a donor substrate. Once the donor has been placed in contact with the target object (usually fabric), heat is applied to the combination (donor and object). At lower temperatures both remain inert, but as the temperature of the combination rises it triggers a catalytic phase change in each of the fabric enhancer previous to the dyeing and or printing of the object donor in the same machine. FIG. 2. is a chart displaying the relationship between the time and the temperature for releasing the chemical elements.

Under room temperature, a donor with special dyes and prints has been conditioned with a bleaching agent, calcium hypochlorite in concentration of 1:20; silver oxide, an antimicrobial agent, in concentration of 1:50; and Scotchgard, a stain release agent prior to sublimation.

Once the donor is treated, it goes through single-pass sublimation machinery starting with preheating at an optimal temperature of 260° F. The sublimation process starts at point A and the donor remains inert due to the low temperature and short amount of sublimation time. As the donor material continues to sublimate at a temperature of 290° F. for around 1.80 seconds at point B1, calcium hypochlorite, the bleaching agent, is activated. Immediately following the activation of the bleaching agent, the donor material proceeds further through the single pass machine and the anti-microbial agents are activated at 330° F. for 2.0 seconds at point B2. Next, the stain release agent is activated at an even higher temperature of 365° F. for a total sublimation time of 2.25 seconds at point B3. Then without interruption, the sublimation single pass machines sublimates the donor onto the receiver, a fabric for dyeing and printing stage in the single pass machine at a temperature of 385° F. for a total of 2.5 seconds at point C. The entire sublimation process can be finished in less than one minute with a continuous seamless process without any environmental impact.

Thus, specific embodiments and applications of a time and temperature additives scheduling have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of operating a sublimation printing device, comprising:

providing a donor for sublimation onto a receiver;

juxtaposing at least a portion of the donor with at least a portion of the receiver;

sublimating a first fabric enhancer from the donor above a first temperature;

sublimating second fabric enhancer that sublimate from the donor above a second temperature, and wherein the first and second fabric enhancer is selected from the group consisting of: a finishing agent, a conditioning agent, a bleach, an antimicrobial substance, and a stain release agent, and wherein the second temperature is at least 10° F. higher than the first temperature and first and second catalysts that trigger the first and second fabric enhancers to sublimate at the first and second temperatures, respectively in one continuous process; and wherein the donor comprises first and second different colorants, each of which sublimates from the donor at a temperature of at least 260° F. and heating the donor from temperature (T1) to temperature (T2) for a period of time (S), defined by $Q=M\cdot(T1-T2)\cdot S$, wherein Q is energy in calories to sublimate the donor and M is the mass of the receiver.

2. The method of claim 1 wherein at least one of the catalysts is selected from the group consisting of olefins, sulfonium compounds, polyaniline compounds, and tetra-amido macrocyclic ligands.

3. The method of claim 1 wherein the first and second temperatures differ by at least 20° F.

4. The method of claim 1 wherein the first and second temperatures differ by at least 30° F.

5. The method of claim 1, further comprising sublimating a donor onto the receiver to produce a fabric wherein the fabric contains visually detectable amounts of both first and second colorants and the fabric further contains a detectable amount of the first fabric enhancer.

6. The method of claim 5, wherein the first and second colorants are sublimated onto the fabric in a continuous disposition.

7. The method of claim 5, wherein the fabric contains a detectable amount of the second fabric enhancer.

8. A method of operating a sublimation printing device, comprising:

providing a donor for sublimation onto a receiver;

juxtaposing at least a portion of the donor with at least a portion of a receiver;

sublimating a first fabric enhancer from the donor above a first temperature;

sublimating second fabric enhancer that sublimate from the donor above a second temperature, and wherein the first and second fabric enhancer is selected from the group consisting of: a finishing agent, a conditioning agent, a bleach, an antimicrobial substance, and a stain release agent, and wherein the second temperature is at least 10° F. higher than the first temperature and first and second catalysts that trigger the first and second fabric enhancers to sublimate at the first and second temperatures, respectively in one continuous process; and wherein the donor comprises first and second different colorants, each of which sublimates from the donor at a temperature of at least 260° F. and heating the donor from 260° F. to 385° F. over a time period of at least 0.35 seconds.

* * * * *